United States Patent [19]

Robinson

[11] Patent Number: 4,782,764

[45] Date of Patent: Nov. 8, 1988

[54] TABLE WITH ANNULAR LEAVES

[76] Inventor: Floyd E. Robison, 7918 Joseph St., Fort Smith, Ark. 72903

[21] Appl. No.: 140,498

[22] Filed: Jan. 4, 1988

[51] Int. Cl.[4] ..... A47B 13/08; A47B 11/00

[52] U.S. Cl. ..... 108/90; 108/104; 108/150

[58] Field of Search ..... 108/90, 104, 150, 135, 108/142

[56] References Cited

U.S. PATENT DOCUMENTS

| | | | |
|---|---|---|---|
| 604,766 | 5/1898 | Korell | 108/104 |
| 1,669,671 | 5/1928 | Owens | 108/104 |
| 2,347,753 | 5/1944 | Sengpiel | 248/188.7 X |
| 2,591,215 | 4/1952 | Thiel | 108/104 |
| 3,405,897 | 10/1968 | Bond | 248/188.7 |
| 4,450,774 | 5/1984 | Weaver | 108/142 X |

FOREIGN PATENT DOCUMENTS

| | | | |
|---|---|---|---|
| 570797 | 2/1933 | Fed. Rep. of Germany | 108/150 |
| 319435 | 7/1934 | Italy | 108/150 |
| 359521 | 2/1962 | Switzerland | 108/104 |
| 981384 | 1/1965 | United Kingdom | 108/150 |

*Primary Examiner*—James T. McCall
*Attorney, Agent, or Firm*—Robert R. Keegan

[57] ABSTRACT

There is disclosed a circular table suitable for use as a dining table or the like, including a round, rotatably mounted table top supported by four outwardly extending feet and a standard which is provided with removably attachable arms to be secured to the top portion thereof, which arms extend beyond the periphery of the table top to support a plurality of leaves in the form of sectors of an annulus, such leaves being removably securable at the ends of the arms whereby the rotatable circular table top can be extended to a larger circular area with the outer annular surface thereof flush with the table top and non-rotatable. The entire table top and extensions are solely supported from the central standard with no other vertical legs for support. The rotatable table top is provided with means for locking it in position if desired. The size of the table is subject to variation, but it may, for example, have a 42 inch diameter center portion and a 70 inch extended diameter thereby seating four to six people for dining without extension and up to 10 people with the extension provided by the leaves.

17 Claims, 3 Drawing Sheets

TABLE WITH ANNULAR LEAVES

The present invention relates to tables for dining or like purposes which have provision for increasing the size of the table surface, as may be desired for special occasions. More particularly the present invention provides a table which has a permanently mounted circular table top which is optionally rotatable, and which is provided with generally annular leaves with concave edges matching the outline of the circular table top together with removable support arms for supporting the leaves from a central standard of the table so that they are adjacent and preferably flush with the permanent table top surface.

The table according to the present invention has numerous advantages over other well known arrangements for providing an extended surface area for a dining table by use of removable leaves or the like. Drop leaf tables or center leaf tables normally extend in one dimension only when the leaves are added, thus even though the original table is square or round it becomes rectangular or oval upon addition of leaves to the table. With a table according to the present invention the table which is originally circular may also be circular upon additions of the leaves; in many cases this achieves better utilization of the available space.

By way of example, consider a circular table according to the invention with a 42 inch diameter circular table top and having 14 inch leaves so that the extended table diameter is 70 inches. The periphery of the 42 inch table is approximately 132 inches while the periphery of the extended table with leaves is approximately 220 inches. Up to six people may be seated at the smaller table, and up to 10 people may be seated at the larger table, allowing about 22 inches of table edge for each plate. Comparing this with a rectangular table which seated six people, it will immediately be observed that the length of the table would have to be increased by 44 inches to provide comparable space for four additional plates. Thus it will be seen that for many dining areas the circular table of the present invention will conveniently provide space for more places at the table than the conventional drop-leaf or center-leaf rectangular table.

An added feature of the present invention is the rotatable center portion intended for use when the leaves are in place. When the small table is used alone the rotatable table top will normally be locked in place as rotation would be of little utility. Since the leaves provide ample width and depth for dinner plates, glasses, etc., the center rotatable table top surface may be used in the fashion of a lazy susan to transport serving dishes or the like around the table to the diners.

While lazy susans for dining tables are known they customarily require extra structure and an additional surface above the table top, whereas the present invention provides a rotatable surface for the large dining table with very little additional structure required. A lazy susan for dining tables is shown for example in U.S. Pat. No. 893,210 to Weeks, dated July 14, 1908, and in U.S. Pat. No. 2,589,719 to McKinney, dated Mar. 18, 1952, class 311-110. A table with a motor driven rotating center portion for packing candy is shown in U.S. Pat. No. 1,143,279 to Johnson, dated June 15, 1915.

A table with a revolving center portion used as a steam table is shown in U.S. Pat. No. 2,191,100 to Starling, dated Feb. 20, 1940, class 126-33. A multiple table structure having fixed and rotatable portions is shown in U.S. Pat. No. 4,248,477 to Netters, dated Feb. 3, 1981, class 297/135. None of the foregoing patents provide an expandable table of circular shape with annular fixed leaves and a rotatable center portion, however. U.S. Pat. No. 3,437,390 to Evans, dated Apr. 8, 1969, class 312-237 shows apparatus for facilitating repair of electronic equipment including a rotatable center table and cabinet to which may be secured dollys or carts on the four sides thereof, somewhat in the fashion of table leaves; the dollys are each independently supported on casters and the apparatus is in no way adaptable for use as a dining table. U.S. Pat. No. 4,060,038 to Ruvolo, dated Nov. 29, 1977, class 108/94, shows a dining room table with a rotatable portion; the rotatable part of the Ruvolo table is small and in no event intended to serve as a self-sufficient dining table. Rather it is used only in conjunction with a plurality of arcuate, free-standing tables which are not connected to the central rotatable section, or the pedestal which supports it. The legs which support the outer portions of the table necessarily create substantial interference with placement of chairs at the table; the central portion of the table is not intended to be used alone and the extension tables are not adapted to convenient storage.

The above patents, and any other known examples of art, do not provide the advantages of a circular table with annular leaves supported from the central standard of the table as more fully described hereinafter.

In addition to providing the features and advantages described above, it is an object of the present invention to provide an extendable table suitable for dining or the like wherein an extended surface substantially in the form of an annulus is provided by leaves secured around the periphery of the unextended table top.

It is another object of the present invention to provide such a table wherein the central table top has a single supporting central standard or pedestal, and the leaves are secured thereto without any peripheral legs or other depending structure interferring with placement of seats around the table.

It is yet another object of the present invention to provide such a table wherein the central table top is rotatable, and a small clearance between the leaves and table top is provided so that the table top may be rotated while the leaves remain stationary.

It is still a further object of the present invention to provide such a table wherein the leaves are supported by substantially horizontal, removable arms, each of which supports the radial edges of a pair of adjoining leaves.

Other objects and advantages of the present invention will be apparent from consideration of the following description in conjunction with the appended drawings in which.

Figure 1:
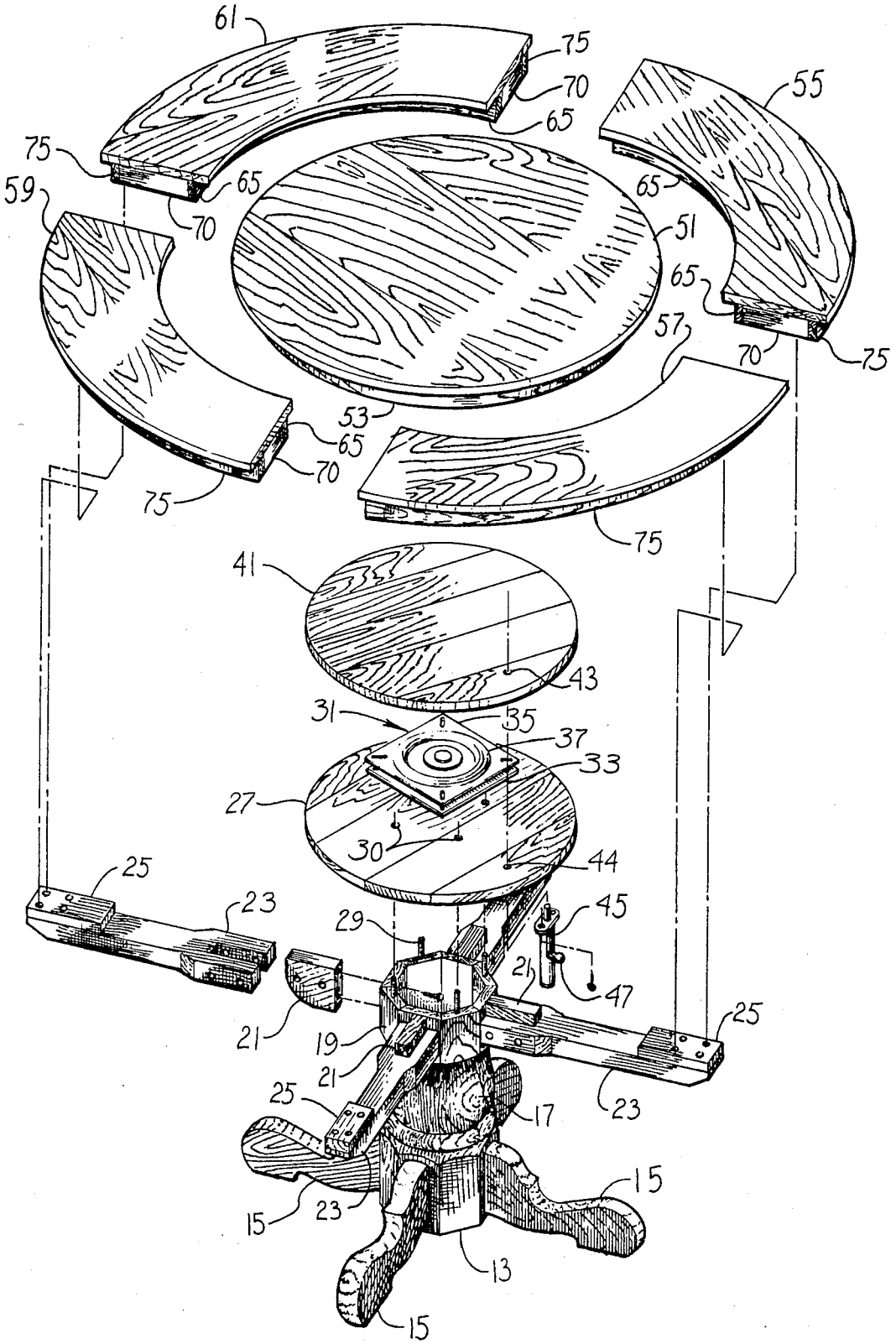
FIG. 1 is an exploded perspective view of a table with annular leaves embodying the invention.

Referring now to the drawings, and particularly FIG. 1, a table 11 with annular leaves according to the invention is shown including a base 13 of octagonal shape to which are affixed four outwardly extending legs 15. A pedestal 17 mounted on the base 13 includes a head portion 19, which may also be of octagonal shape. The base 13, legs 15 and pedestal 17 are preferably configured in an ornamental design as shown, but this forms no part of the present invention.

Shoulder elements 21, which are four in number, extend outwardly from the head portion 19. The portions of the table thus far described and generaly all visible portions of the table may be made of furniture quality hardwood with the pieces secured together by bolts, screws, or other conventional hardware as indicated, for example, in FIG. 1.

The four arms 23 extending outwardly at the level of the head portion 19 are not permanently attached, but rather are demountably secured to the shoulder elements 21 by bolts and wing nuts, or other conveniently removable fastening means. If desired, the shoulder elements 21 may be radially grooved so that the arms 23 slideably engage the shoulder elements 21, in which case the arms 23 may be retained by a single bolt or pin, or the table leaves may be relied upon for retaining such arms 23 in place.

A pad 25 on the end of each arm 23 supports the table leaves as will later be seen, and maintains them at a proper height relative to the table top. A cap 27 is secured on the head portion 19 by bolts 20, or other suitable means, and provides a base for a turntable element 31 of conventional form. The turntable 31 includes a bottom plate 33 and a top plate 35, each of which are provided with races 37 for balls (not shown) whereby plate 35 is easily rotated with minimal friction relative to plate 33. A support member 41 is secured to the top plate 35 of the turntable 31, and thus the support 41 is firmly secured relative to the table pedestal 17 except for rotational motion permitted by the turntable 31. A lock-bolt mechanism 45 is secured relative to the cap 27 and holes 43 and 44 are provided whereby the lock-bolt mechanism 45 may be used to lock the support member 41 relative to the cap 27 by raising a handle 47 to engage the lock-bolt mechanism 45 in the hole 43. The locking mechanism is primarily desirable when the table is used without leaves, and it may be omitted or another form of locking device may be employed.

Figure 3:
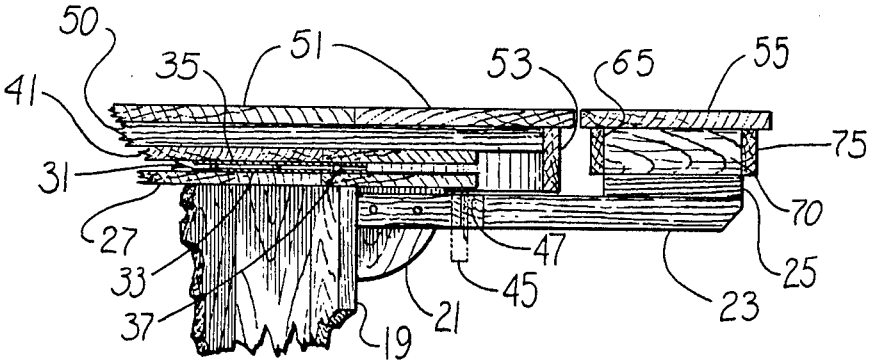
FIG. 3 is a fragmentary sectional view taken along the line 3—3 in FIG. 2.

As best seen in FIG. 3, a table top 51 is provided with cross braces 50 which are secured to the support element 41 with the result that the table top 51 rotates as a unit with the support element 41 and the top plate 35 of the turntable 31. The turntable 31 may be of conventional form, which is readily available, but in any case should be rated to carry a weight of 100 pounds or more. An apron 53 shown in cylindrical form is provided primarily for appearance and to conceal the turntable 31 and other structural portions of the table.

Removable leaves 55, 57, 59, and 61 are provided for the table, which together provide an annular shape enlarging the smaller circular surface of the table top 51 to a larger, but still circular, surface. Each leaf, such as 55, may include an inner apron 65 and an outer apron 75 which serve decorative functions and also strengthen and rigidify the leaf 55.

A mounting block 70 at each end of leaf 55 (and also other leaves) has internally threaded metal inserts mating with holes in the pad 25 whereby the leaf 55 is secured at each end to one of two adjacent arms 23 and pads 25. Arms 23 could be braced from pedestal 17 if desired, but they should not have legs extending to the floor. Although the preferred embodiment shown is contemplated to be constructed entirely of hardwood except for the metal hardware, it could also be constructed of a softer wood such as pine in which case it might be painted or varnished to provide a protective finish, or in other cases some or all parts of the table might be constructed of metal, plastic, or composition materials having a rigidity and strength comparable to the hardwood of the preferred embodiment.

Figure 2:
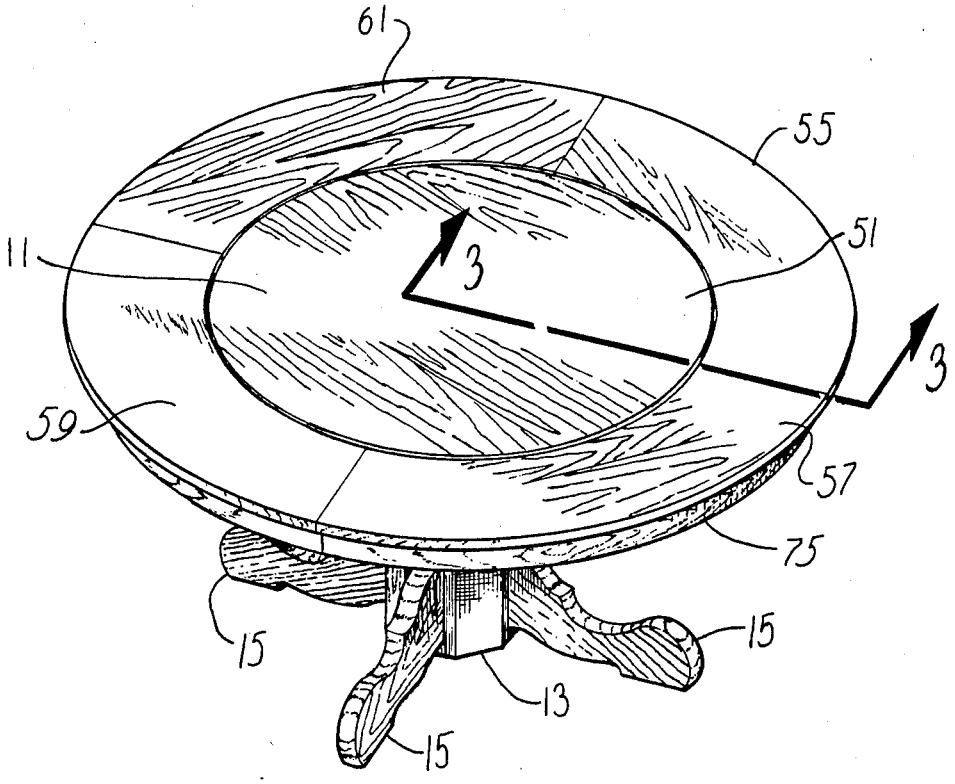
FIG. 2 is a perspective view thereof.

When the table 11 is assembled as indicated in the exploded view of FIG. 1 it will have the appearance shown in FIG. 2, which in a preferred embodiment will permit seating of up to 10 persons, and will provide a rotatable inner table for convenience.

The aprons 53, 65, and 75 are shown of cylindrical form with a smoothly curved shape, however, they may be polygonal so that the apron 53, for example, has sixteen sides.

Figure 4:
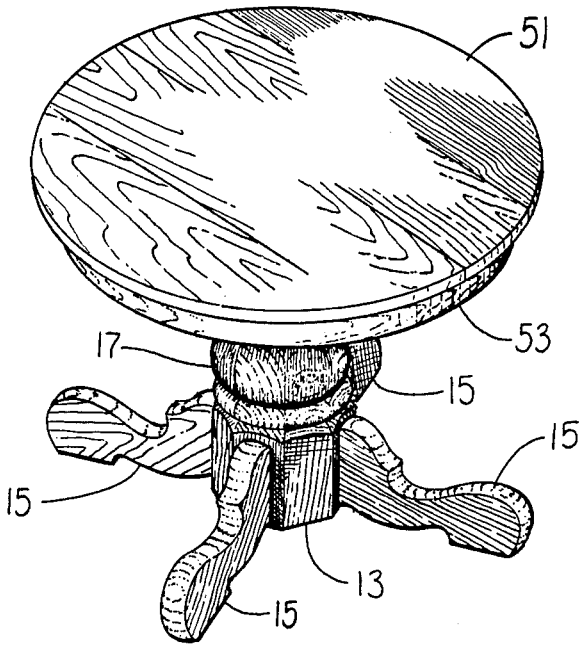
FIG. 4 is a persepctive view of a table according to the invention with the annular leaves and their supports removed.

When the leaves 55, 57, 59, and 61 are removed from the arms 23 and the arms 23 are removed from the shoulder elements 21 then the small unitary circular table will have an appearance as shown in FIG. 4. As previously mentioned, the table of the invention can be made in a substantial range of sizes, but typically the table top 51 may be 42 inches in diameter whereas the entire table as shown in FIG. 2 may be 70 inches in diameter.

It should be noted in particular that while four leaves making up the annular addition to the table are shown, only two leaves of semi-circular form could be employed. It would still be desirable to have four arms 23 providing firm structural support for the table leaves. Other numbers of leaves such as three, five, or six could be provided in a similar fashion; in such cases different numbers of the arms 23 might be utilized.

It is, of course, necessary that the table top 51 be circular if it is to be rotatable, but otherwise it might be of octagonal or similar shape. There is no necessity for the overall shape of the table with leaves as shown in FIG. 2 to be circular, however. It could be oval, ellipitcal, or even rectangular (with or without rounded corners). The circular shape for the extended table is preferred when the center is rotatable in order to allow an adequate depth of non-rotating space for the places at the table while having the rotatable center portion within easy reach of each person.

The rugged construction of thick solid wood or veneer as illustrated is intended to give a substantial appearance to the table design, but clearly the opposite approach could be utilized with lightweight metals or plastics and a much lighter source could be devised to peform the same function as the preferred embodiment.

In addition to the variations and modifications of the invention that have been shown, described or suggested, other variations or modifications will be apparent to those skilled in the art, and accordingly the scope of the invention is not to be considered limited to the particular embodiments described or suggested, but is rather to be determined by reference to the appended claims.

What is claimed is:

1. A circular table extendable by addition of leaves comprising a base with a vertical axis and having at least three legs extending radially from said axis, an upright member mounted on said base, a circular table top mounted on said upright member, at least three arms adapted to removably fasten to and extend radially from the upper half of said upright member, a plurality of table leaves having concave edges which conform to the periphery of said table top, and means for securing said leaves on top of said arms adjacent to said table top to form an extension thereof.

2. Apparatus as recited in claim 1 wherein said table top is rotatably mounted on said upright member.

3. Apparatus as recited in claim 2 further including means for locking said table top to prevent rotation thereof relative to said upright member.

4. Apparatus as recited in claim 1 wherein said table leaves are adapted to surround said table top to form an extended circular surface.

5. Apparatus as recited in claim 1 wherein said means for securing said leaves on top of said arms causes the surface of said leaves to be flush with the surface of said table top with a clearance therebetween of from 1/16 to ¼ inch.

6. Apparatus as recited in claim 1 wherein said arms are adapted to fasten only to the upper quarter of said upright member.

7. Apparatus as recited in claim 1 wherein said upright member is the sole support for said table top.

8. Apparatus as recited in claim 1 wherein said means for securing said leaves on top of said arms includes means on each of said arms for engaging radially extending edges of two adjacent leaves.

9. A circular table extendable by addition of leaves comprising a base with a central vertical axis and having at least three legs extending to a radius from said axis which is at least half the radius of said table, an upright member mounted on said base coaxial with said axis and having a turntable mounted centrally thereon, a circular table top mounted on said turntable, at least three arms adapted to removably fasten to and extend radially and horizontally from the top one-quarter portion of said upright member, a plurality of arcuate table leaves, the concave edges of which conform to the periphery of said table top, and means for securing said leaves on top of said arms to surround said table top with their surfaces substantially flush with the table top surface to form an extension thereof.

10. Apparatus as recited in claim 9 wherein said table leaves are annular and are adapted to surround said table top to form an extended circular surface.

11. Apparatus as recited in claim 9 wherein said means for securing said leaves on top of said arms causes the surface of said leaves and the surface of said table top to have a clearance therebetween of from 1/16 to ¼ inch.

12. Apparatus as recited in claim 9 wherein said upright member is the sole support for said table top.

13. Apparatus as recited in claim 9 further including means for locking said table top to prevent rotation thereof relative to said upright member.

14. Apparatus as recited in claim 9 wherein said means for securing said leaves on top of said arms includes means on each of said arms for engaging radially extending edges of two adjacent leaves.

15. A circular table extendable by addition of leaves comprising a base with a central vertical axis and having at least four legs horizontally extending to a radius from said axis which is at least half the radius of said table, an upright member mounted on said base coaxial with said axis and having a turntable mounted centrally thereon, a circular table top mounted on said turntable, said top having an apron extending downward to conceal said turntable, means for locking said top to prevent rotation thereof relative to said base, at least four arms adapted to removably fasten to and extend radially and horizontally from the top one-quarter portion of said upright member beyond the edge of said table top, a plurality of table leaves each shaped as a sector of an annulus, the concave edges of which conform to the periphery of said table top with a clearance of from 1/16 to ¼ inch, and means for removably securing said leaves to the top of said arms to surround said table top with their surfaces flush with the table top surface to form an annular extension thereof.

16. Apparatus as recited in claim 15 wherein said upright member is the sole support for said table top.

17. Apparatus as recited in claim 15 wherein said means for removably securing said leaves on top of said arms includes means on each of said arms for engaging radially extending edges of two adjacent leaves.

* * * * *